United States Patent [19]

Wanninger

[11] Patent Number: 4,797,080

[45] Date of Patent: Jan. 10, 1989

[54] CONTINUOUS KNEADING MACHINE

[75] Inventor: Peter Wanninger, Heitersheim, Fed. Rep. of Germany

[73] Assignee: IKA-Maschinenbau Janke & Kunkel GmbH & Co. KG, Staufen, Fed. Rep. of Germany

[21] Appl. No.: 868,264

[22] Filed: May 28, 1986

[30] Foreign Application Priority Data

May 30, 1985 [DE] Fed. Rep. of Germany ..... 3519349
Feb. 6, 1986 [EP] European Pat. Off. ..... 86101551.9

[51] Int. Cl.[4] ..... H01J 17/00

[52] U.S. Cl. ..... 425/203; 425/204; 425/205; 425/209; 366/298; 366/300

[58] Field of Search ..... 264/349, 75; 425/204, 425/205, 260, 201; 366/83, 84, 85, 86, 76, 77, 297–301, 307

[56] References Cited

U.S. PATENT DOCUMENTS

| | | | |
|---|---|---|---|
| 2,698,962 | 1/1955 | Swallow | 425/204 |
| 2,767,437 | 10/1956 | Marshall | 425/205 |
| 3,383,096 | 5/1968 | Braibanti et al. | 366/76 |
| 3,466,015 | 9/1969 | Lodige et al. | 366/300 |
| 3,788,613 | 1/1974 | Romero | 366/76 |
| 3,854,627 | 12/1974 | Coons | 366/84 |
| 3,895,781 | 7/1975 | Lodige et al. | 366/300 |
| 3,977,658 | 8/1976 | Wittrock et al. | 366/86 |
| 3,984,905 | 10/1976 | Petzoldt | 82/3 |
| 4,156,707 | 5/1979 | Joshi | 264/75 |
| 4,478,516 | 10/1984 | Kessler | 425/204 |

FOREIGN PATENT DOCUMENTS

| | | | |
|---|---|---|---|
| 775069 | 8/1956 | United Kingdom | 366/297 |

*Primary Examiner*—Bernard Nozick
*Attorney, Agent, or Firm*—Peter K. Kontler

[57] ABSTRACT

A kneading machine with a charging opening leading to a kneading chamber, in which two axially parallel kneading tools can be driven in opposite directions at different rotational speeds, has at least three such kneading chambers which are disposed next to each other and an aperture which connects their internal spaces. The material to be kneaded can be conveyed through this aperture, which extends transversely of the shafts of the kneading tools from one kneading chamber to the next, so that the material is continuously treated until it reaches in the last kneading chamber an evacuating opening and preferably an evacuating worm which is mounted at such location and by means of which the material is ultimately evacuated from the machine. In this manner, the advantages of a kneading machine with shafts for kneading tools which are journalled at both ends are combined with the advantages of continuous treatment of the material to be kneaded. This also renders it possible to vary the shapes of kneading tools in the of kneading chambers.

24 Claims, 3 Drawing Sheets

Figure 1:
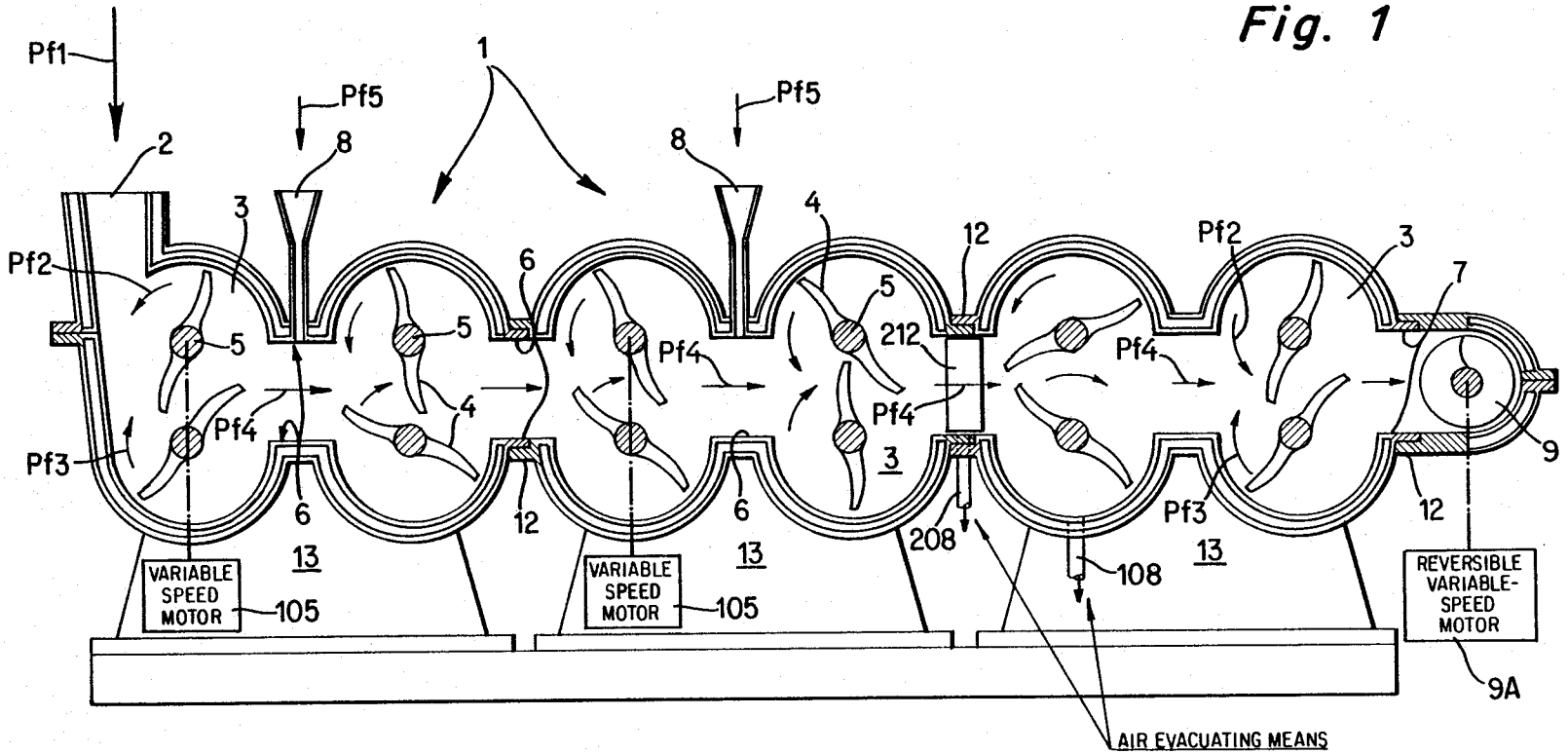

1
2
3
4
5
6
7
8
9
11
12
13
Pf1
Pf2
Pf3
Pf4
Pf5

CONTINUOUS KNEADING MACHINE

The invention relates to a kneading machine with a charging opening and with kneading chambers which are adjacent each other and have apertures connecting their internal spaces and extending transversely of the shafts of kneading tools, and wherein pairs of axially parallel kneading tools can be driven in opposite directions, preferably at different rotational speeds.

Such kneading machines are known for numerous applications. As a rule, a charge which is admitted into the kneading chamber by way of the charging opening must be treated for a certain period of time and, if necessary, is provided with additives prior to evacuation.

Single- or twin-shaft screw type mixing extruders are used in the plastics- and rubber industries for some time to homogeneously admix solid or liquid additives to synthetic plastic- or rubber masses at elevated temperatures in the thermoplastic- or in the solvent phase. The additives can constitute solid filler materials and reinforcing agents such as sodium carbonate, silicate, asbestos, talcum, kaolin, metal oxides, coloring agents, glass fibers, synthetic reinforcing fibers, graphite fibers, boron fibers as well as liquid additives such as softening agents.

To a lesser extent, it is also necessary to admit into polymeric materials accurate concentrations, and preferably in a homogeneous distribution, of substances such as antioxidants, light intercepting agents, stabilizers, cross-linking agents, slip additives, treatment facilitating auxiliary agents, fireproofing agents, antistatics and blowing agents.

As a rule, the process is carried out in such a way that the filler materials, additives and synthetic plastic granulates are admitted by means of metering scales, are mixed with each other in a continuously operating mixing extruder generally while in a thermoplastic state, and are extruded through nozzles at the head end of the extruder in the form of strands which are thereupon granulated in a severing machine.

Thus, mixing extruders can also be used to carry out mixing- and/or plasticizing operations.

By way of example, the next-following shaping can be carried out by admitting the synthetic plastic granulates into injection molding machines which convert them into shaped articles.

In the majority of cases, the percentage of filler materials in commercially utilized synthetic plastic- or rubber products is approximately 50 percent or less in order to avoid an excessive lowering of mechanical stability and other important characteristics of the synthetic plastic parts.

A further new field of application for continuously operated mixing extruders is the making of propellants and explosive substances as well as of pyrotechnic articles.

In this field of endeavor, the treated substances include primarily solid propellants, pulverulent propellant charges, explosive charges with synthetic plastic binders and pyrotechnic articles. In many instances, so-called double-base solid propellants were produced in accordance with the thermoplastic treating method whereas other products were treated in the solvent phase or in a viscous state due to the utilization of a liquid polymeric binder.

In contrast to the previously described filler-containing synthetic plastic- and rubber articles, and due to their specific application, such products occasionally contain a high percentage of solid or liquid additives which can even amount to, e.g., approximately 70% to 95%. In such instances, the percentage of polymeric binders is only approximately 30% to 5% and, in certain instances, could actually be treated only with assistance from solvents.

In connection with many substances in this field of manufacture, such as for example when the polymeric component is nitrocellulose, the materials are sensitive to impact and friction. The same applies for the components of explosive materials. Such materials and compounds are frequently also highly sensitive to temperatures and explode at temperatures between 170° Celsius and 250° Celsius.

Heretofore, the just discussed problems have interfered with and rendered difficult the utilization of continuously operating machines. Such problems were attributable to a number of reasons some of which can also be found in the extruder systems. In order to ensure thorough intermixing, it is necessary to employ mixing worms the length of which is approximately 15- to 30 times their diameter in order to ensure a sufficient interval of dwell for the required cross-linking treatment in the extruder.

A further important prerequisite is a highly accurate metering of raw materials because hardly any return flow, and hence hardly any mixing with oncoming materials, such as could compensate for eventual inaccuracies in metering, takes place in an extruder, even in the kneading zones.

A further serious difficulty in connection with the treatment of propellants and explosive materials is to be seen in the potential contact between the adjacent walls and extruder worms which are journalled only at one of their ends. The likelihood of contact with the walls cannot be excluded in view of the pronounced length of the worms, even when the machine is completely filled. However, many substances which are sensitive to friction and impact can be ignited under such stresses which can lead to fires, explosions or even to detonations in the event of damming.

Another problem which must be taken into consideration, especially during treatment of propellants and explosive substances, is attributable to the already mentioned high percentage of filler materials. The cross-linking and homogenizing process cannot be completed in an optimum fashion during the short period of dwell which is in the range of a few minutes so that it is often necessary to pass the same material several times or to rely on preliminary mixing in accordance with the batch mixing procedure.

U.S. Pat. No. 2,698,962 and German Auslegeschrift No. 11 31 389 already disclose kneading machines of the aforementioned type wherein pairs of kneading chambers are disposed one above the other and in each of which kneading worms are installed. In such machines, and particularly when dealing with a completely or partially pulverulent and/or granular starting material, there exists the danger that the material to be kneaded will advance prematurely by gravity from the one into the other kneading chamber and from there to the evacuating opening under the action of gravity before it assumes the desired consistency.

Furthermore, gravity ensures a relatively rapid further transport of the kneaded material, also in the cases of other types of kneadable material, so that the period of dwell of the material to be kneaded is relatively short.

Accordingly, it is an object of the invention to provide a kneading machine of the aforementioned type which can ensure a longer period of dwell of the material to be kneaded and which should render it possible to allow for continuous mixing and kneading of sensitive propellant and explosive materials as well as other filler-containing synthetic plastic materials to a high degree of homogeneousness without the danger that the mixing and kneading tools would contact the wall of the kneading chamber. At the same time, one should achieve a satisfactory densification of the kneaded product on leaving the kneading machine so that it is possible to avoid, as far as possible, the influence of air or the like which might have been worked into the material during kneading.

The solution of this object consists in that at least three kneading chambers are disposed next to each other in a substantially horizontal row and are connected to each other by apertures, and by the provision of an evacuating worm at the end of the row of kneading chambers at the evacuating opening of the last kneading chamber.

Due to the provision of a horizontal row of more than two kneading chambers, one achieves, on the one hand, an intensification of the treatment of the material to be kneaded and, on the other hand, the elimination of accelerating influence of the gravity force upon the advancement of the material to be kneaded so that the period of dwell of the material to be kneaded in the kneading machine can be prolonged by a combination of such undertakings. Furthermore, the evacuating worm which is disposed at the end can densify the material to be kneaded once more and, in addition, can influence the period of dwell in accordance with the selected rotational speed.

This is due to the fact that a further development of the invention can consist in that the rotational speed of the evacuating worm is variable and/or that the direction of rotation and the direction of transport is reversible. This, too, renders it possible to change at will the period of dwell of the material to be kneaded. Furthermore, the evacuating worm can reach the rotational speed zero between a reversal of the rotational speed and the speed of transport, and this can also interfere to a considerable extent with the evacuation of material to be kneaded and can thus prolong its period of dwell.

The aforedescribed undertakings can be assisted in that the outlet of the housing of the evacuating worm is narrowed and preferably constitutes an extruder nozzle. In this manner, one achieves first of all a certain pileup in the interior of the evacuating worm which can bring about, during evacuation, a desired densification of kneaded material upon completion of the kneading treatment.

It will be seen that the advantages of a kneading machine with pairs of axially parallel kneading tools and several kneading chambers are retained in that the kneading tools can be journalled at both ends so that they can perform a thorough intermixing and kneading operation. At the same time, one ensures a sufficiently long period of dwell of the material to be kneaded in the kneading machine because three or more such kneading chambers are disposed horizontally next to each other so that the material to be kneaded can advance gradually from chamber to chamber without being moved forwardly at an excessive speed due to the force of gravity so that it is possible to ensure a continuous treatment for a sufficiently long interval of time. On the one hand, mixing and kneading can be influenced and prolonged by a selection of the number of kneading chambers but it can also be influenced in a finished machine having a fixed number of kneading chambers with assistance from the evacuating worm.

In view of the continuous mode of operation, a fresh material to be kneaded can be admitted into the charging opening while the treated material can be evacuated from the last of the series of neighboring kneading chambers at the evacuating opening and at the outlet of the evacuating worm.

Thus, it is possible to ensure a continuous treatment which conforms to the requirements of the selected material to be kneaded.

Kneading blade shafts which are normally utilized in such kneading machines can generate in the material to be kneaded very pronounced compressive, tensional and shearing forces with the resulting generation of pronounced friction which leads to excellent dispersion and homogeneousness. Due to the provision of connecting apertures between one kneading chamber and the next, such kneading tools and kneading blades perform an additional function in that they also advance the material to be kneaded gradually to such aperture and ultimately into the next kneading chamber. The number of neighboring kneading chambers can be selected in dependency upon the desired period of dwell.

The rotational speed of kneading tools in one chamber can differ from those in at least one other chamber. In other words, not only is it possible to drive the two kneading tools in a chamber at rotational speeds which differ from each other, but such rotational speed can also vary from chamber to chamber if the nature of the material to be kneaded renders this necessary. For example, the rotational speed of tools in a chamber which follows in the direction of advancement of the material to be kneaded could be lower than that of the tools in at least one of the preceding kneading chambers. In such manner, one can achieve with time a certain pileup and hence a sufficiently long period of dwell of the material to be kneaded. Furthermore, such rotational speeds can be varied in order to take into consideration whether or not the material to be kneaded alters its viscosity in the course of treatment.

A development of the invention which is of considerable significance and exhibits substantial advantages can consist in that admitting openings for liquid and/or solid additive materials are provided between and/or on the kneading chambers. In this manner, the material to be kneaded can be gradually provided with further additive substances during its continuous treatment, and such substances are admixed in the next-following chambers and are kneaded into the material to be kneaded. In such instance, it can be of advantage if the rotational speed of kneading tools in one kneading chamber at or behind the apertures for admission is higher than the rotational speed of kneading tolls in a kneading chamber ahead of the additional metering, for example, in order to take into consideration the increase in the volume of the substance which is being kneaded, and the thus increased mass of material to be kneaded can advance at a correspondingly increased speed.

A particularly advantageous compromise between a satisfactory period of dwell of the material to be kneaded and a reasonable outlay for the machine can consist in that one can provide four kneading chambers next to each other. This allows for an intensive kneading and intermixing greatly exceeding the kneading in two kneading chambers which are disposed above each other whereby the overall height remains small in spite of the substantial number of kneading chambers, and one achieves the desired intensive treatment at four kneading locations.

A further embodiment of the kneading machine according to the invention which not only improves the kneaded products but also prevents the entrapment of air in such products—which is particularly important in connection with the making of propellants and explosive substances—can consist in that at least one connection for the generation of subatmospheric pressure is provided for at least one kneading chamber and/or at the connection between two kneading chambers.

In this connection, it is particularly advantageous if a connection for the generation of subatmospheric pressure is provided at the last and/or at the next-to-the-last kneading chamber and/or the housing of the evacuating worm so that the kneaded material is relieved of an held free of entrapped air not later than at the end of its treatment.

It was already mentioned that the kneading tools can constitute kneading blades which lead to a correspondingly intensive treatment of the material to be kneaded and, in addition, to an advancement of material from kneading chamber to kneading chamber to thus perform a dual function.

In addition, it is possible to provide certain kneading chambers with rollers and/or polygonal discs which constitute kneading tools in lieu of kneading blades. Such construction is possible due to the novel arrangement of several kneading chambers next to each other and thus allows for a variety of treatments of the material to be kneaded within the individual chambers. While the kneading blades primarily produce a satisfactory mixing effect, the rollers and polygonal discs can be used to achieve more satisfactory kneading effects. Thus, and due to the placing of several kneading chambers next to each other and due to the provision of different kneading tools, one can selectively influence the material to be kneaded in a number of different ways.

It is particularly advantageous if at least two kneading chambers with kneading blades are disposed in series one after the other downstream of the charging opening of the kneading machine and are followed by kneading chambers with rollers and/or polygonal discs. In this manner, one ensures that the material to be kneaded is mixed in a highly satisfactory manner in a first step and is also subjected to a preliminary kneading treatment before it is acted upon by the rollers or polygonal discs which carry out primarily a comminuting and plasticizing work, especially if they are heated.

Sieves or baffles for subdivision and/or pushers for piling up the material flow can be arranged between at least two kneading chambers. This also allows for a regulation and influencing of the period of dwell of the material to be treated in the individual chambers. The positions, the paths which are defined thereby as well as the orientation of sieves, baffles and/or pushers can be adjusted in order to regulate the material stream. Such construction, too, is possible due to placing of several kneading chambers next to each other in a row and allows for selective changes in the material stream and in the period of dwell of the material to be kneaded in individual kneading chambers.

It is advisable to provide each pair of kneading tools in a kneading chamber with its own drive, e.g., an oil motor. In this manner, one can individually select the desired rotational speeds and rotational speed differences from chamber to chamber. Nevertheless, one achieves a relatively simple construction as concerns the overall outlay for the machine.

In order to be in a position to alter, if necessary, the number of kneading chambers which are disposed next to each other, it is of advantage if a connection for the inlet opening of a next-following neighboring chamber or the evacuating worm is provided at the outlet opening of each kneading chamber.

All in all, there is provided a kneading machine which renders it possible to continuously treat the material to be kneaded in dependency upon the requirements and wherein the period of dwell can conform to the momentary requirements.

Nevertheless, it is preferred to mount the kneading tools outside of the kneading chambers so as to allow for problem-free treatment of friction- and impact-sensitive substances, especially since each kneading tool can be journalled at each of its ends. Dangers which develop in connection with the treatment of explosive materials as a result of frictional engagement of tools with the walls are fully avoided by the thus selected arrangement. Since the kneading machine can actually constitute a modular construction, it is highly versatile and can be used for and can conform to a wide variety of mixing, kneading, comminuting and plasticizing operations in connection with a variety of materials to be kneaded. If an extruding nozzle or a similar constriction is provided at the outer end of the evacuating worm resp. in its housing, one achieves the additional advantage that the treated material is simultaneously converted into a strand so that it can be conveyed out of the machine and transported away in a particularly advantageous manner.

Figure 2:
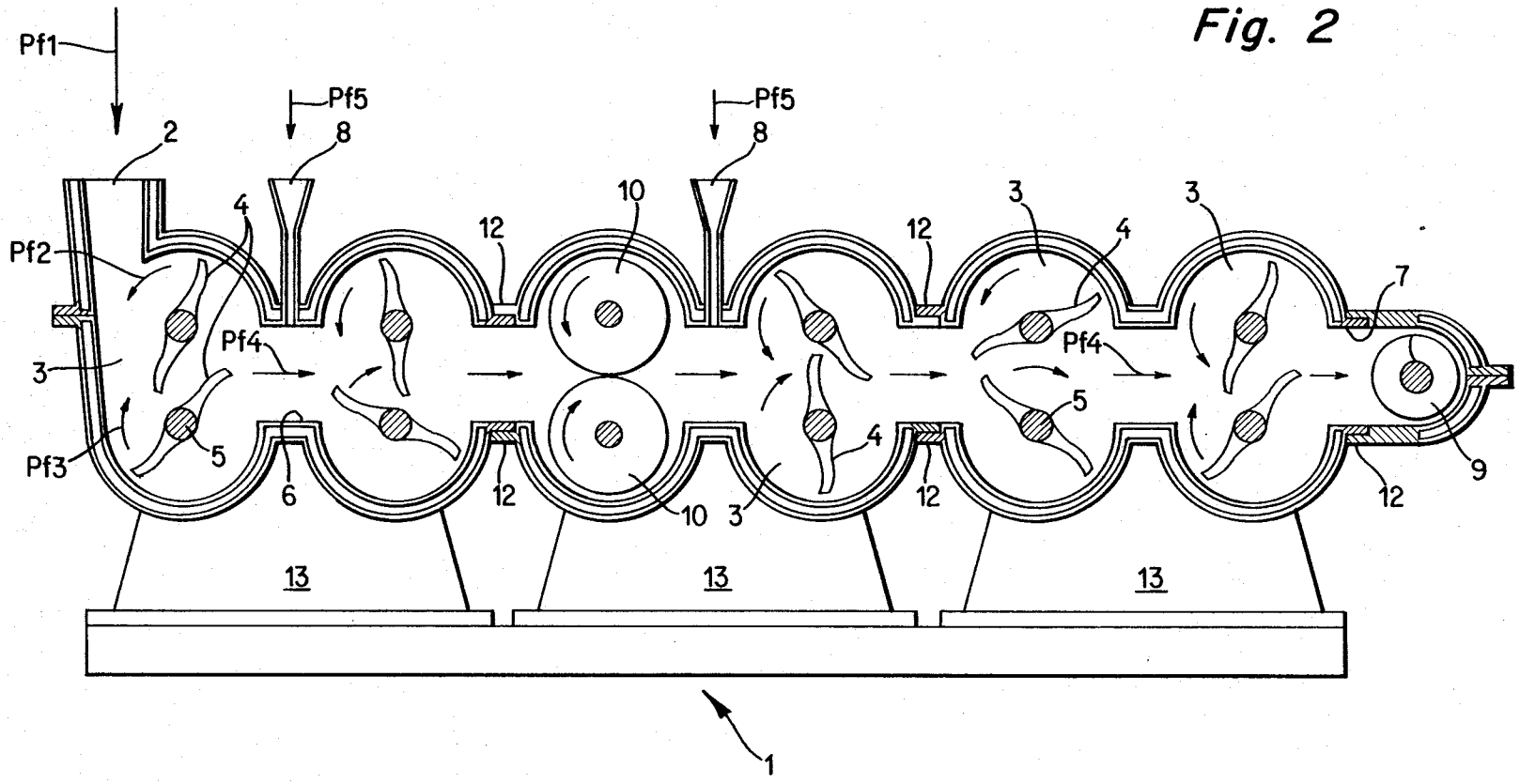
Figure 3:
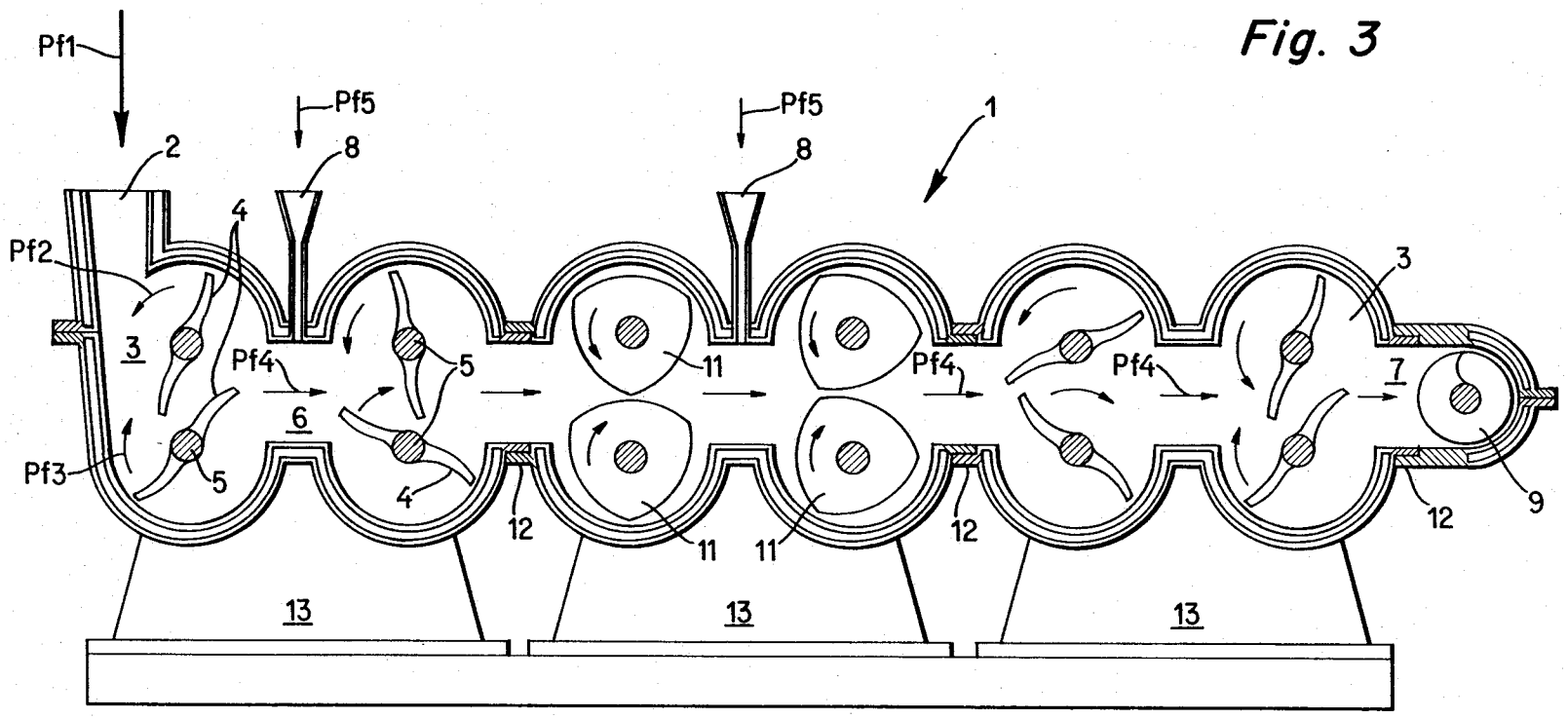

FIG. 1 is a longitudinal sectional view of a novel kneading machine with several kneading chambers which are disposed next to each other and each of which is shown in section, each kneading chamber containing kneading blades, FIG. 2 is a view corresponding to that of FIG. 1 but with rollers, constituting kneading tools, provided in the third chamber and rotating in opposite directions, and FIG. 3 is a representation to that of FIGS. 1 and 2 but wherein the third and fourth kneading chambers contain kneading tools in the form of polygonal discs.

A kneading machine which is designated as a whole by the character 1 has a charging opening 2 through which the material to be kneaded is introduced in the direction of the arrow Pf1 to enter a first kneading chamber 3. The kneading chamber 3 contains two kneading members or tools 4 whose shafts 5 are parallel to each other and are driven in opposite directions, as indicated by the arrows Pf2 and Pf3, and at different rotational speeds. As shown, several kneading chambers 3 are disposed adjacent each other in a horizontal row and have apertures 6 which connect their internal spaces, which extend transversely of the shafts 5 of the kneading tools 4 and by way of which the material to be kneaded is advanced from one kneading chamber 3 into the next as indicated by the arrows Pf4. The last of the series of kneading chambers 3 which are disposed next to each other has an evacuating opening 7 through which the fully treated material to be kneaded is withdrawn.

The rotational speeds of kneading tools 4 in one of the chambers 3 can deviate from those in at least one other chamber 3. For example, the rotational speed of tools 4 in a next-following chamber 3, as seen in the direction of transport according to the arrows Pf4, can be less than that of the tools 4 in at least one of the preceding kneading chambers 3 so as to develop a certain pileup at the apertures 6 and to thus prolong the period of dwell in each preceding kneading chamber 3.

Furthermore, it is shown that, in all of the embodiments, admitting openings 8 can be provided between pairs of kneading chambers 3 to deliver and add liquid or solid additives into the material to be kneaded as indicated by the arrows Pf5.

In such instances, it is desirable that the rotational speed of the kneading tools 4 in a kneading chamber 3 behind an opening for admission of metered quantities exceed that of the kneading tools 4 in a kneading chamber 3 ahead of the metering opening 8 because, due to controlled admission of material, the quantity of material to be kneaded increases and, therefore, it is possible to increase somewhat the rate of transport in order to avoid an excessive pileup.

In the illustrated embodiment, the evacuating opening 7 of the last chamber 3 at the end of the row of kneading chambers 3 contains an evacuating worm 9. For example, the latter can have a nozzle or a similar end portion so that the kneaded material issues in the form of a continuous strand and leaves the kneading machine 1 to be continuously subjected to a further treatment.

The aforementioned nozzle or a similar constriction at the outlet of the evacuating worm 9 further causes the development of a certain pileup in the interior of the worm so that the kneaded material is subjected to additional densification during its evacuation. The rotational speed of the evacuating worm 9 can be varied (see the reversible variable-speed motor 9A in FIG. 1), and it is also possible, if necessary, to even change the direction of its rotation and hence the direction of advancement of material by the evacuating worm 9 so as to temporarily prevent the discharge of kneaded material for a selected interval of time and to thus influence and prolong the period of dwell.

In a manner which is not shown in detail, it would be possible to provide the kneading chambers 3, and particularly the last kneading chambers as seen in the direction of advancement according to the arrows Pf4, with one or more connections (note the air evacuating means 108 in FIG. 1) for the generation of subatmospheric pressure in the interior of the kneading chambers 3 in order to avoid or eliminate the entrapment of air.

In the embodiment according to FIG. 1, all kneading tools 4 constitute kneading blades.

In the embodiment of FIG. 2, one of the kneading chambers 3 is provided with rollers 10 instead of kneading blades whereas, in the embodiment according to FIG. 3, the third and fourth kneading chambers 3 contain kneading tools in the form of polygonal discs 11. The first two successive kneading chambers 3 immediately behind the charging opening 2 are provided with kneading blades followed by the kneading chambers 3 which contain the rollers 10 or the polygonal discs 11. Thus, the arrangement of several kneading chambers 3 in a row next to each other not only allows for a continuous treatment but also renders it possible to influence the mechanical action upon the material to be kneaded by employing different types of kneading tools 4.

As clearly shown, the evacuating opening 6 or 7 of a kneading chamber 3 is provided with a connection 12 for the inlet opening of the next-following neighboring chamber 3 or the evacuating worm 9 so that the through-flow apertures 6 are formed by coupling such connections 12 to each other. Furthermore, this renders it possible to lengthen or shorten the row of kneading chambers 13, depending on the nature of the material to be treated or the substance to be kneaded if the connectors 12 can be separably coupled to each other. The character 208 denotes in FIG. 1 a means for evacuating air from one of the connections 12, and the character 212 denotes an obstruction (such as a baffle or a sieve) in one of the evacuating openings 6.

All in all, there is provided a kneading machine 1 of simple construction wherein pairs of kneading chambers 3 are carried jointly by a supporting leg 13. As shown in the drawing, it is also possible to fixedly connect pairs of kneading chambers 3 to each other and to couple them with two similar additional chambers. In this manner, it is possible to conform, practically at will, not only the number of such kneading chambers but also kneading tools which are used therein to the selected material to be kneaded and to retain the advantages of heretofore known charge-type kneading machines with two axially parallel kneading tools 4 in a common kneading trough.

At the same time, the material to be kneaded can be treated continuously with simultaneous further transport of the material from kneading chamber 3 to kneading chamber 3 and its withdrawal by means of the evacuating worm 9. The heretofore existing danger of frictional engagement between the walls and kneading tools and the like in accordance with presently known continuous kneading operation with assistance from extruding worms is avoided so that the novel kneading machine 1 is suitable also for the treatment of readily ignitable, flammable or explosive substances as well as other substances which are to undergo a highly intensive mixing and kneading. Each pair of kneading tools 4 can have its own drive, for example, with assistance from an oil motor. Two variable-speed motors 105, each of which can constitute an oil motor, are shown in FIG. 1. As shown, it is possible to place six kneading chambers 3 next to each other even though it is also possible to employ only three kneading chambers. A satisfactory compromise between the mechanical outlay and the period of dwell can consist in the utilization of four, eventually five, kneading chambers 3 next to each other. It is also thinkable to employ as many as seven or more kneading chambers 3.

All features and structural details which are referred to in the description, in the summary and in the claims and are shown in the drawing can be of essential importance, either individually or in any desired combination with each other.

I claim:

1. A kneading machine comprising a housing having an at least substantially horizontal row of at least three communicating neighboring kneading chambers including a first chamber and a last chamber, said first chamber having a charging opening for admission of the material to be kneaded and said last chamber having an evacuating opening for kneaded material; first and second substantially axially parallel rotary kneading members provided in each of said chambers; means for rotating the first and second kneading members in opposite directions; and a driven worm provided in said evacuating opening.

2. The machine of claim 1, further comprising means for rotating said worm at a plurality of speeds.

3. The machine of claim 1, further comprising means for rotating said worm in clockwise and counterclockwise directions.

4. The machine of claim 1, wherein said row comprises four neighboring kneading chambers.

5. The machine of claim 1, further comprising means for evacuating air from at least one of said chambers.

6. The machine of claim 1, further comprising means for connecting said neighboring chambers to each other and means for evacuating air from said connecting means.

7. The machine of claim 1, wherein said row further comprises a next-to-the-last chamber and further comprising means for evacuating air from at least one of said last and next-to-the-last chambers.

8. The machine of claim 1, wherein at least one of said kneading members comprises a kneading blade.

9. The machine of claim 1, wherein at least one kneading member in at least one of said chambers includes a roll.

10. The machine of claim 1, wherein at least one kneading member in at least one of said chambers includes a polygonal disc.

11. The machine of claim 1, wherein said chambers include two successive chambers and an additional chamber following said successive chambers in the direction in which the material is advanced from said charging opening to said evacuating opening, the kneading members in said successive chambers including blades and at least one kneading member in said additional chamber including a roll.

12. The machine of claim 1, wherein said chambers include two successive chambers and an additional chamber following said successive chambers, the kneading members in said successive chambers including blades and at least one kneading member in said additional chamber including a polygonal disc.

13. The machine of claim 1, wherein said chambers include at least one group of two chambers which are connected to each other and at least one additional chamber which is separably connected to one chamber of said group.

14. The machine of claim 1, wherein said rotating means comprises means for rotating at least one kneading member in one of said chambers at a first speed and means for rotating at least one kneading member in at least one other chamber at a higher second speed.

15. The machine of claim 14, wherein said other chamber precedes said one chamber in the direction of advancement of material from said charging opening to said evacuating opening.

16. The machine of claim 1, further comprising means for admitting at least one additive into at least one of said kneading chambers.

17. The machine of claim 16, wherein at least one of said chambers is located upstream and at least one of said chambers is located downstream of said additive admitting means in the direction of advancement of material from said charging opening toward said evacuating opening, said rotating means comprising means for rotating at least one kneading member in said upstream chamber at a first speed and means for rotating at least one kneading member in said downstream chamber at a higher second speed.

18. The machine of claim 1, further comprising at least one obstruction interposed between at least two of said neighboring chambers.

19. The machine of claim 18, wherein said obstruction includes a sieve.

20. The machine of claim 18, wherein said obstruction includes a baffle.

21. The machine of claim 1, wherein said rotating means comprises discrete drives for the kneading members in said chambers.

22. The machine of claim 21, wherein at least one of said drives comprises an oil motor.

23. The machine of claim 1, wherein said neighboring chambers have registering apertures and further comprising means for connecting the neighboring chambers to each other in the regions of the respective apertures.

24. The machine of claim 23, wherein said connecting means include means for separably coupling the neighboring chambers to each other.

* * * * *